US009101237B2

(12) United States Patent
Artsvelyan

(10) Patent No.: US 9,101,237 B2
(45) Date of Patent: Aug. 11, 2015

(54) MULTI-USE TOWER PLATES

(76) Inventor: Albert Artsvelyan, Glendale, CA (US)

( * ) Notice: Subject to any disclaimer, the term of this patent is extended or adjusted under 35 U.S.C. 154(b) by 294 days.

(21) Appl. No.: 13/436,119

(22) Filed: Mar. 30, 2012

(65) Prior Publication Data

US 2012/0248000 A1 Oct. 4, 2012

Related U.S. Application Data

(60) Provisional application No. 61/516,322, filed on Mar. 31, 2011.

(51) Int. Cl.
*B65D 21/00* (2006.01)
*B65D 85/62* (2006.01)
*A47G 19/02* (2006.01)

(52) U.S. Cl.
CPC ..... *A47G 19/02* (2013.01)

(58) Field of Classification Search
CPC ..... B65D 21/0209; B65D 21/0233; B65D 21/04; B65D 21/0235
USPC ..... 206/501–505, 509, 546, 426; 99/646 C, 99/382, 383, 416–418; 215/10, 392, 393, 215/395; 220/574, 573.5
See application file for complete search history.

(56) References Cited

U.S. PATENT DOCUMENTS 1,800,491 A * 4/1931 Zoia ..... 206/502
1,919,765 A * 7/1933 Barnes ..... 62/531
2,210,283 A * 8/1940 Guy ..... 206/502
2,294,657 A * 9/1942 Flanagan ..... 220/575
D193,308 S 7/1962 Jackson
D256,205 S 8/1980 Bateman
D319,705 S 9/1991 Tsai
5,573,133 A * 11/1996 Park ..... 220/4.27
D390,752 S * 2/1998 DeCoster ..... D7/505
D413,487 S 9/1999 Vitali
6,135,307 A * 10/2000 Fahy ..... 220/574
D452,146 S 12/2001 Lin
6,681,684 B1 1/2004 Chen
D493,384 S 7/2004 Jensen
D504,799 S 5/2005 Lawson
D512,604 S 12/2005 Panepinto
7,021,202 B2 * 4/2006 Sizer ..... 99/415
D543,074 S 5/2007 Luft
D568,102 S * 5/2008 Ruiz de Az a ..... D7/505
D572,537 S 7/2008 Bardolet
D574,188 S 8/2008 Beny
D577,961 S 10/2008 O'Brien
D593,364 S 6/2009 Harris
D593,800 S 6/2009 Hone
D601,385 S 10/2009 Savage
D603,577 S 11/2009 Lin
7,690,151 B2 4/2010 Wilkes
7,943,888 B2 * 5/2011 Barnes et al. ..... 219/432

* cited by examiner

*Primary Examiner* — Luan K Bui
*Assistant Examiner* — Rafael Ortiz
(74) *Attorney, Agent, or Firm* — Adli Law Group P.C.

(57) ABSTRACT

Provided is a tower made from base plates that can function as an ornamental table centerpiece, to which additional plates can be added to give the appearance of a flower.

19 Claims, 9 Drawing Sheets

FIG. 5A
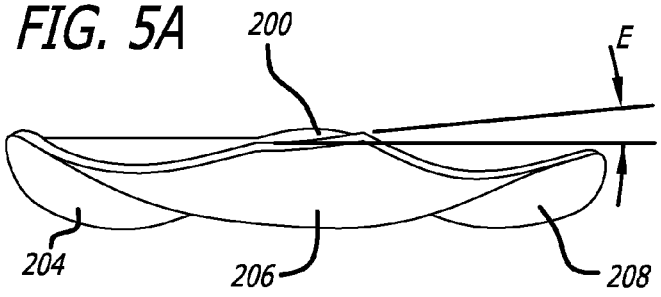
FIG. 5B
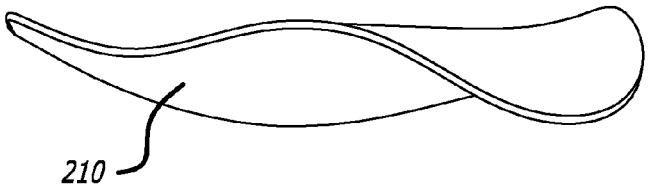
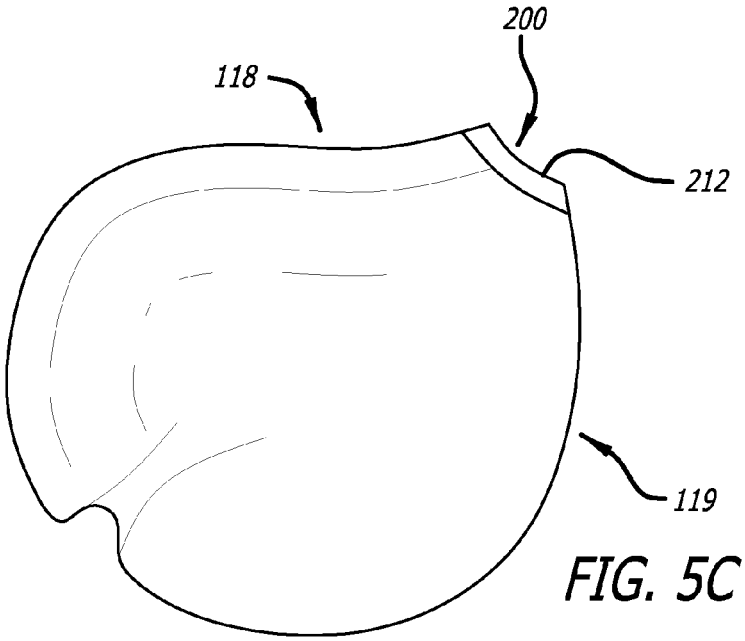
FIG. 5C

FIG. 7A
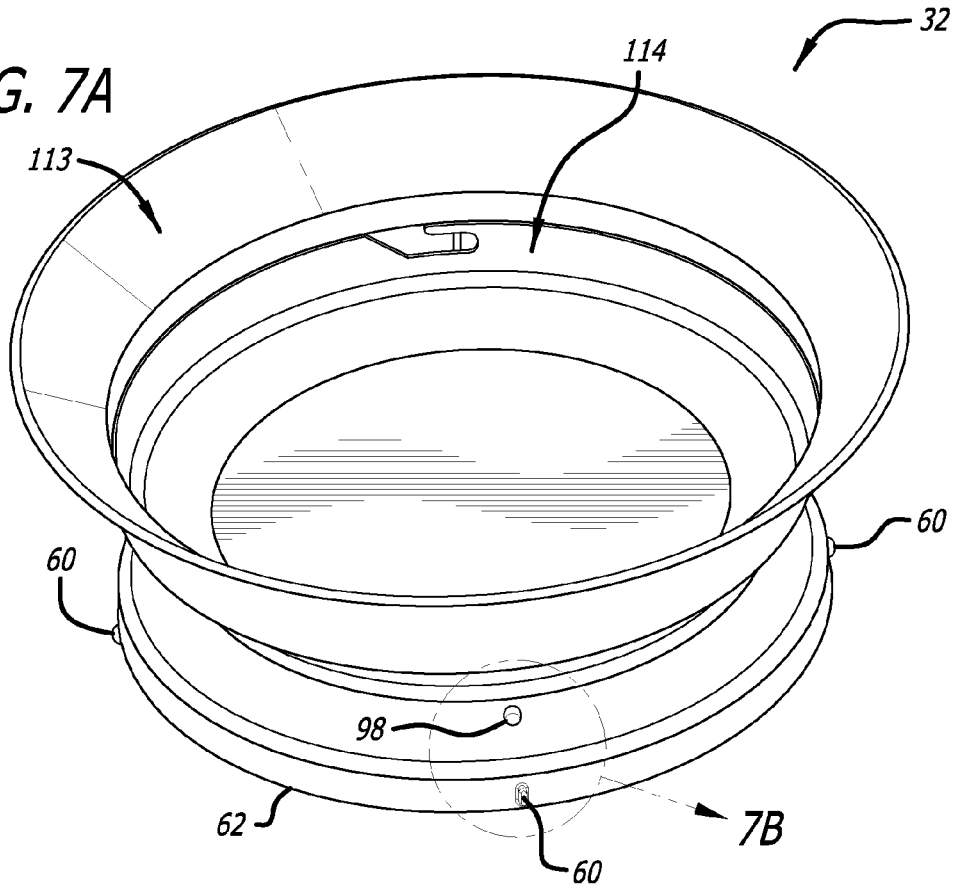
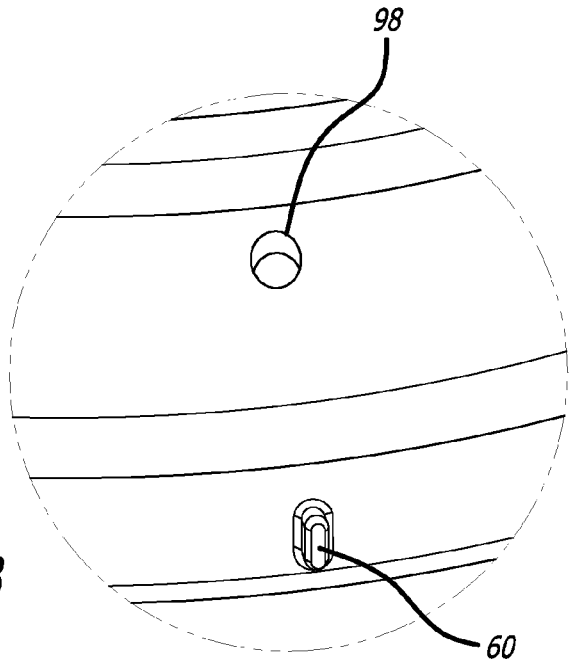
FIG. 7B

MULTI-USE TOWER PLATES

CROSS-REFERENCE

The application claims the benefit of U.S. provisional application No. 61/516,322, filed on Mar. 31, 2011, which is incorporated herein by reference in its entirety.

FIELD OF THE INVENTION

This invention relates to a tower formed from multiple plates and bowls for serving food, that can be connected in a stacking arrangement. The tower can function as an ornamental table centerpiece, and can also be disassembled into individual serving plates and bowls.

BACKGROUND OF THE INVENTION

Plates, such as bowls for serving, particularly party plates, are available in a wide variety of different designs, sizes, colors, shapes, and materials. Oftentimes, when hosts want to serve food, such as desserts or appetizers, to their guests; they find it necessary to buy matching serving plates, in addition to the regular plates, from which their guests consume food. Plates are typically stacked separately in the corner of a table, were the individual guest can pick a plate, or are set on the table according to the number of guests. But no matter how the plates are distributed, by the end of the occasion, the plates and bowls eventually end up in the trash or the dishwasher, depending on their material. And, a week later, if the guests are asked what kind of plates or bowls were at the party, almost no one will remember.

Further, expensive and luxurious foods, such as seafood, deserve a presentable and practical serving. Today, there are numerous ways to serve seafood (mostly shrimp), but the platters are not very impressive, and if they are, they typically do not include ice. In some restaurants, shrimp is served directly on ice, which after some time melts, leaving the food in a pool of water which can detract from the appearance and taste of the food.

There remains a need for additional, attractive arrangements of food serving plates and bowls that can hold and maintain over time, a variety of foods.

SUMMARY OF THE INVENTION

Provided in one embodiment is a stackable tower for serving food comprising:

a) a first base plate having a bottom and a top portion, with the top portion for placing food, with the bottom portion for supporting the top portion, said bottom portion having a first and a second segment, with the first segment shaped to receive and detachably attach to another base plate, and a second segment below the first segment that protrudes out, wherein the first base plate can be used independently to serve food, b) a second base plate having a bottom and a top portion, with the top portion for placing food, with the bottom portion having a size and shape necessary to be detachably attached to the first segment of the first base plate, wherein the second base plate can be used independently to serve food;

wherein after attaching the first and second base plates, a compartment is formed in between the exterior of the second plate and the second segment of the first base plate;

wherein food can be placed in the top portion of the first base plate with the second base plate supporting the tower, or food can be placed in the second base plate top portion and compartment with the first base plate supporting the tower. After attaching the first and second plates, a chamber holding air can form in between the bottom of the first and the bottom of the second plates. An opening can exist in between the first and second base plates after attaching them to allow for a liquid to drain into the chamber. An additional opening can exist for air to escape as liquid enters the chamber. One embodiment further comprises detachably attaching one or more additional base plates to the second base plate or each successive plate, wherein each additional plate has a bottom and top portion, with the top portion for placing food, and the bottom portion detachably attaching to the top portion of the second plate or each successive plate in such manner to cut the top portion into a lower and an upper part, the first lower part forming a chamber, and the upper part forming an additional compartment along exterior of the additional plate. Each additional base plate can create a compartment that is steeper that the previous compartment, allowing for placing a plate or ornamental object in the compartment at increasing angles. In one embodiment, a total of three plates is stacked on the first base plate. The plates or ornamental objects can be displayed by using the compartment as a support. The plates can be in the shape of a flower petal are used. A plate in shape of a rose petal can be used, said plate having a spherical shape with one or more flaps, and a narrowing from the flaps to form an edge that is contoured to allow for stacking of the plates. The plates or the ornamental objects can have an edge contoured for the tower, wherein the edge is tilted to allow for stacking of multiple plates or ornamental objects. The angle of tilting can be about 5 degrees to about 15 degrees from a horizontal plane. All the base plates can be circular in shape. An opening can form as a result of diametrical difference between the first and second base plate to allow liquids to drain. The second base plate can comprise a top portion and a bottom portion, the top portion having a chamber area for receiving an additional plate and a section protruding outwards from the chamber area, and the bottom portion having a first portion protruding out followed by a section with a compatible shape and size to detachably attach to the first base plate. Sauce can be put in the second base plate or a subsequently attached plate, and seafood in the compartment next to the second plate or subsequently attached plate.

Provided in one embodiment is a stackable tower for serving food comprising:

a) a first base plate having a bottom and a top portion, with the top portion for placing food, with the bottom portion supporting the top portion, said top portion having a first and a second segment, with the first segment shaped to receive and detachably attaching to another base plate, and a second segment above the first segment that protrudes out, wherein the first base plate can be used independently to serve food, b) a second base plate having a bottom and a top portion, with the top portion for placing food, with the bottom portion having a size and shape necessary to be detachably attached to the first segment of the first base plate, wherein the second base plate can be used independently to serve food;

wherein after attaching the first and second base plates, a compartment is formed in between the exterior of the second plate and the second segment of the first base plate, and food can be placed in the second base plate and the compartment, with the first base plate supporting the tower. The tower can comprise additional base plate. The tower can further comprise plates or ornamental objects that are displayed by using the compartment as a support. Food can be served on the bottom of the first base plate.

BRIEF DESCRIPTION OF THE DRAWINGS

The invention is herein described, by way of example only, with reference to the accompany drawings, wherein:

FIG. 5*a-c* illustrates a plate for stacking against the tower in the shape of a rose petal.

FIGS. 7*a* and *b*, shows additional structural details of another plate, having lock protrusions for detachably attaching in the notches of another plate, and an opening to allow air to leave from the chamber as liquid enters the chamber.

DETAILED DESCRIPTION OF THE INVENTION

Figure 1:
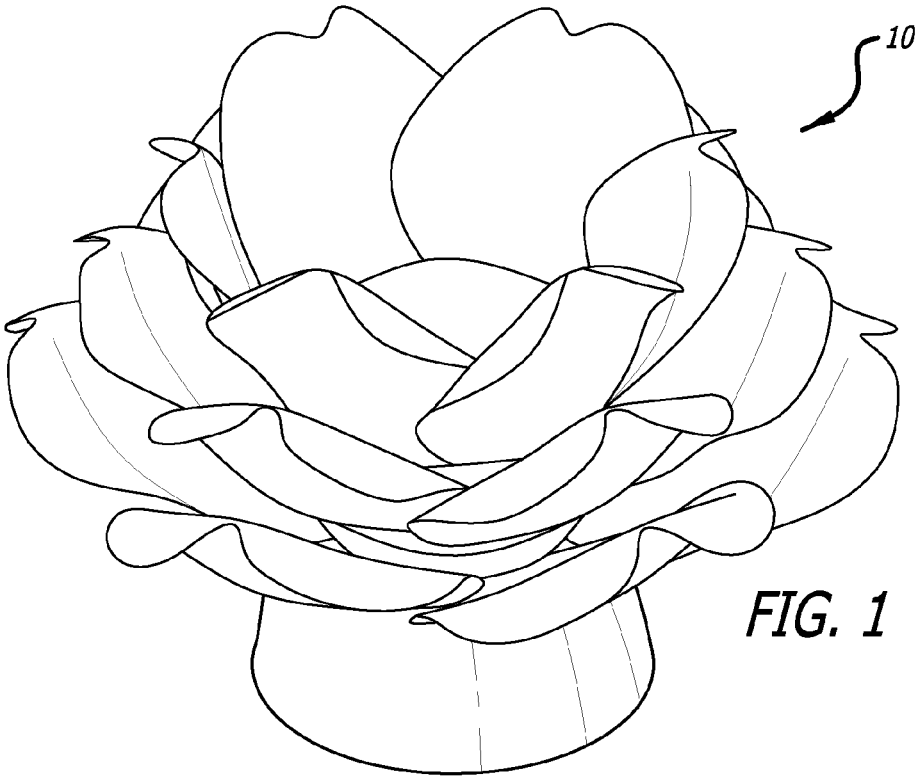
FIG. 1 is a perspective view the assembled, stacked food serving plates and bowls in a tower having the ornamental appearance of a flower.

The present invention provides a centerpiece in the form of a tower by stacking base plates. These base plates can be used in independently or stacked together to form such tower. The design of the base plates allows for forming a compartment next to or all around the base plates in the tower. The compartment can be used for placing food, particularly sea food such as shrimp. The compartment can hold ice, and the water from the ice can drain into a chamber formed by staking the base plates together. Instead of using the compartment for food, ornamental objects or additional plates, particularly in the shape of rose petals can be stacked against the tower. Guests can then each take a petal plate from the tower. The tower can hold numerous petal plates, such as about 10 to about 30 plates, such as 18 plates.

The first base plate (30) in one embodiment is the first component of the tower (107) that carries the entire centerpiece. Preferably it is the biggest base plate in the tower. The first base plate (30) has a bottom portion (109) and a top portion (108) for placing food, with the bottom portion (109) for supporting the top portion (108). The bottom portion (109) has a first segment (72) and a second segment (110), with the first segment (72) shaped to receive and detachably attach to another base plate. The second segment (110) below the first segment (72) protrudes out. The second segment (110) would touch a table or other support. The first base plate can be used independently to serve food. When having a circular shape, the diameter of the first base plate at its neck can be about 3 inches to about 24 inches.

Figure 8A:
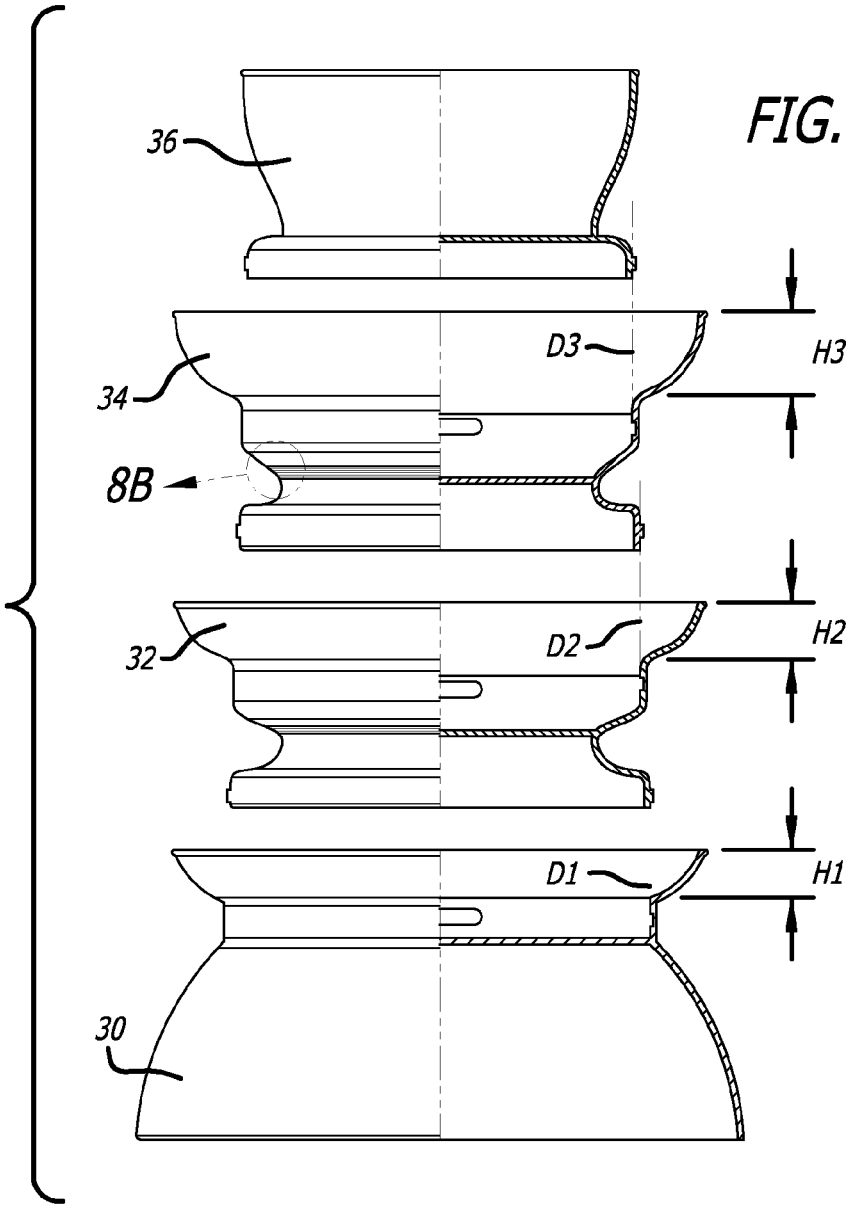
FIGS. 8*a* and *b*, shows an exploded cross-sectional view of four plates depicted in stacking configuration to form a tower. Each base plate is shown from the outside (left half of each base plate); and inside, in cross section (right half of each plate) (8*a*); and detail of a texturized outer surface of the bowls (8*b*).
Figure 8B:
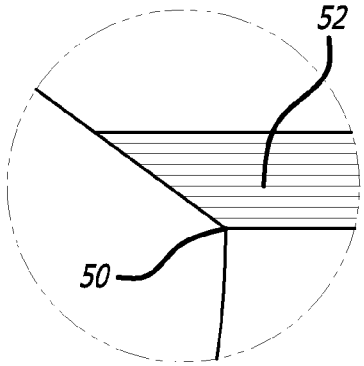

The first base plate is then attached to one or more additional base plates. The attachment is typically done through the bottom of both base plates so the top portion of either one can be used for serving food by just flipping the tower. (FIG. 8).

The second base plate (32) has a bottom (112) and a top portion (111), with the top portion for placing food. The bottom portion has a size and shape necessary to be detachably attached to the first segment (72) of the first base plate (30). When not attached, the second base plate can be used independently to serve food.

The second base plate can be adapted to be detachable attached to additional base plates. The top portion of the second plate (111) can have a chamber area (114) for receiving an additional plate and a section protruding outwards from the chamber area (113). The bottom portion can have a first portion protruding out (115) followed by a section with a compatible shape and size (116) to detachably attach to the first base plate (30).

Each additional base plate (34, 36) can have a bottom and top portion, with the top portion for placing food, and the bottom portion detachably attaching to the top portion of the second plate (111) or each successive plate in such manner to cut the top portion into a lower (114) and an upper part (113), the first lower part forming a chamber (92, 94), and the upper part forming an additional compartment (82, 84) along the exterior of the additional plate.

The design of the first plate can be changed so it does not have a substantial place for placing food. In other words, it only acts as a base, and the tower is not designed to be flipped and used in either configuration. So in effect, in this configuration, all the base plates have a top portion that is in the same direction, with each subsequent plate being joined to the top portion of the first plate. A bottom to bottom attachment is avoided. The configuration is that in FIG. 3 without the large base plate number 30 being present.

Anywhere from two to an infinite number of plates can be stacked together. Preferably about 2 to about 10 plates are stacked together, more preferably about 3 to about 5 plates.

The plates are detachably attached to each other. Any acceptable method of attaching can be used. Different type of locking systems, like snap fit, press fit and even threaded system, can be used to lock or connect the base plates together as well. Attachment can also be done through a tight fit.

The plates can have any shape, such as circular, square, rectangular, odd shape, or oval. Preferably the plates are in the shape of circular bowls.

Figure 3:
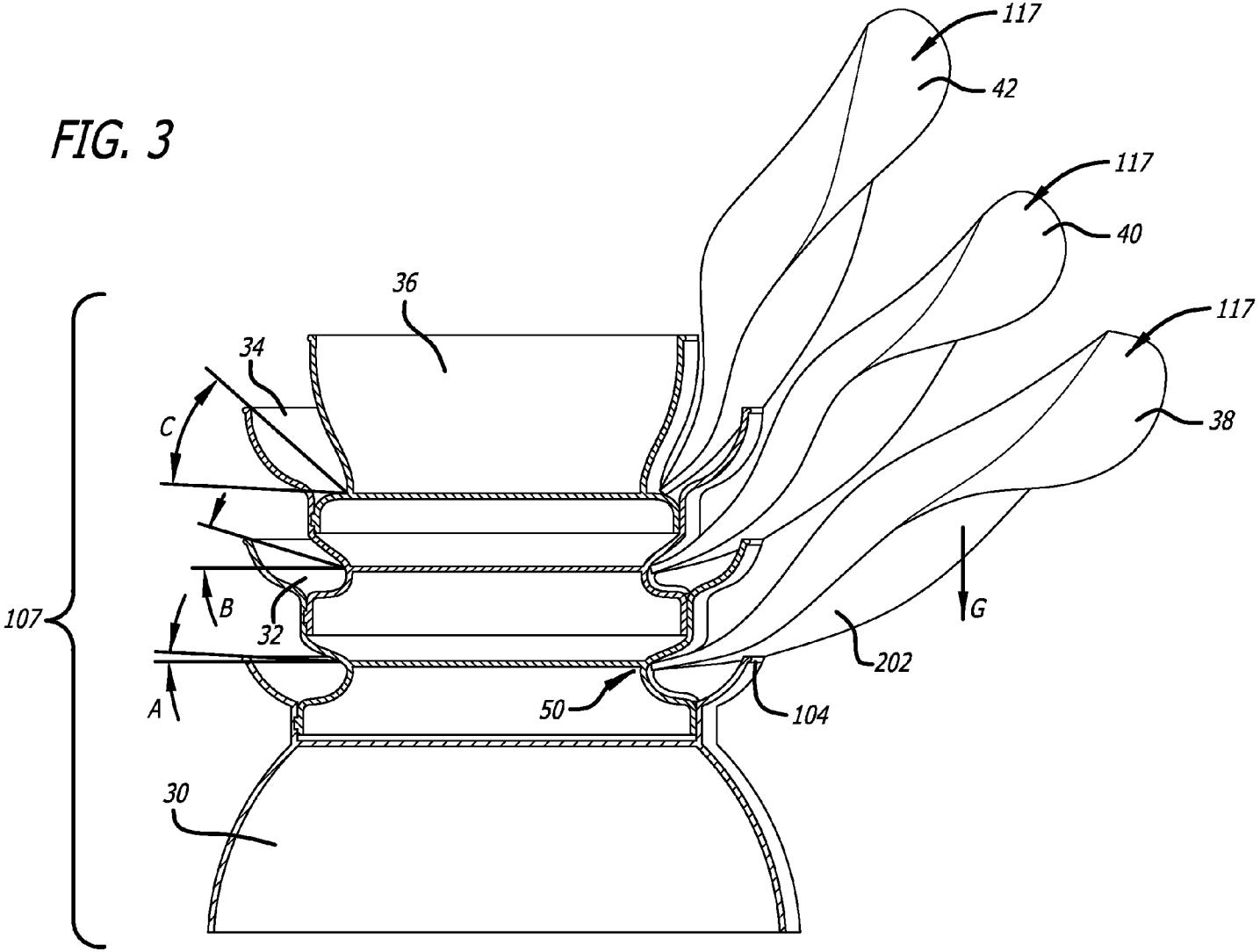
FIG. 3 is a cross-sectional view of the stacked bowls of the tower having petal shaped plates inserted on one side. Each successive petal has a an increasing angle due to a steeper compartment.
Figure 4:
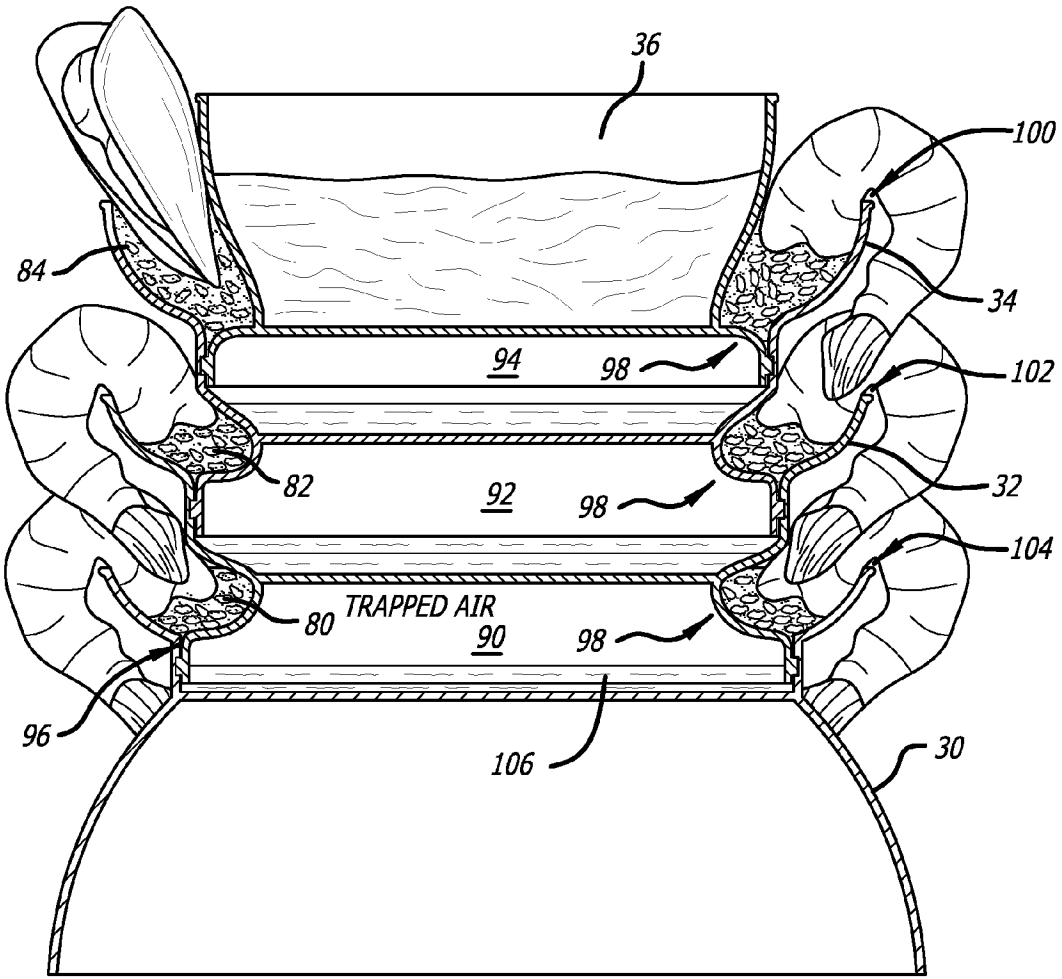
FIG. 4 is an additional cross-sectional view, showing shrimp displayed and maintained on ice that is placed in compartments of the tower, and showing the flow path of water from the melting ice into chambers in between the base plates.

A compartment (80, 82, 84) is formed when stacking plates together. The compartment is designed to hold food or additional plates or ornamental objects. The protrusions of the base plates (110, 113) allow for creating a space between the exterior of the newly attached plate and the protrusion. FIG. 3 demonstrates 3 of these compartments that are formed all around in which petal plates are placed. FIG. 4 shows putting ice and shrimp in the same compartments. As illustrated in FIG. 3, each subsequent compartment is preferably made to be steeper, so the petals are held at a bigger angle, allowing for less interference between each petal and better overall ornamental look.

The stacking of the plates can form a chamber (90, 92, 94). This chamber allows for liquid to drain from compartment formed when adding the additional base plate. A chamber holding air forms in between the bottom of the first and the bottom of the second base plates. A chamber also forms in between the top of the second plate and the bottom of any third plate. An opening exists in between the first and second base plates (or second and third base plate) after attaching them to allow for a liquid to drain into the chamber. An additional opening exists (98) for air to escape as liquid enters the chamber. The opening where liquid can escape forms as a result of diametrical difference between the first and second base plate to allow liquids to drain.

Additional plates, preferably in shape of lower petal such as rose petal, are placed against the tower (FIG. 3). These are placed in the compartments as illustrated in FIG. 3. One petal plate is illustrated in FIG. 12. The plate has a spherical shape (206) with one or more flaps, preferably two (204, 208), and a narrowing from the flaps (118, 119) to form an edge that is contoured to allow for stacking of the plates. The narrowing of the flaps can be more curved on one side (118 or 119).

The plates or the ornamental objects have an edge contoured for the tower, wherein the edge is tilted to allow for stacking of multiple plates or ornamental objects. Typically, with a circular base plate design, the narrow edge (200) is contoured to also be circular and fit against the tower. To allow for stacking of multiple plates, the narrow edge can have a tilting angle (E in FIG. 5), preferably about 5 degrees to about 15 degrees from a horizontal plane.

The petal plates can have multiple sizes. Big petal plate can be assembled on the first row, supported by first and second base plates. Preferably about 4 to about 10, such as six are attached. Medium petal plate assembled on the second row, supported by second and third base plates Preferably about 4 to about 10, such as six are attached. Small petal plate assembled on the third row, supported by third and fourth base plates. Preferably about 4 to about 10, such as six are attached. All three row plates are assembled under different angles, giving room for each person to pick the plate and give an image of blossomed flower.

Figure 9:
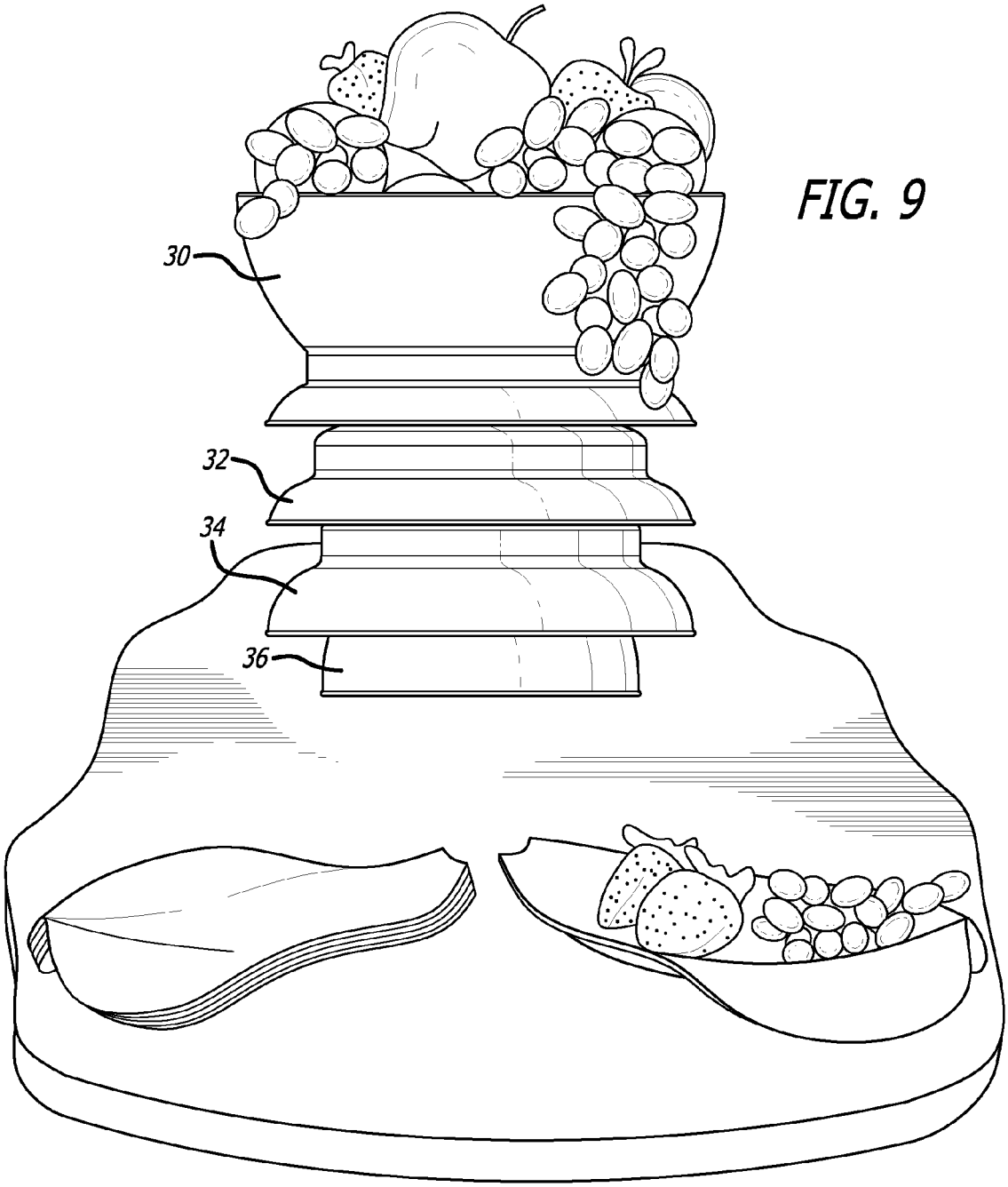
FIG. 9 shows a side view of four base plates in stacking configuration.
Figure 10:
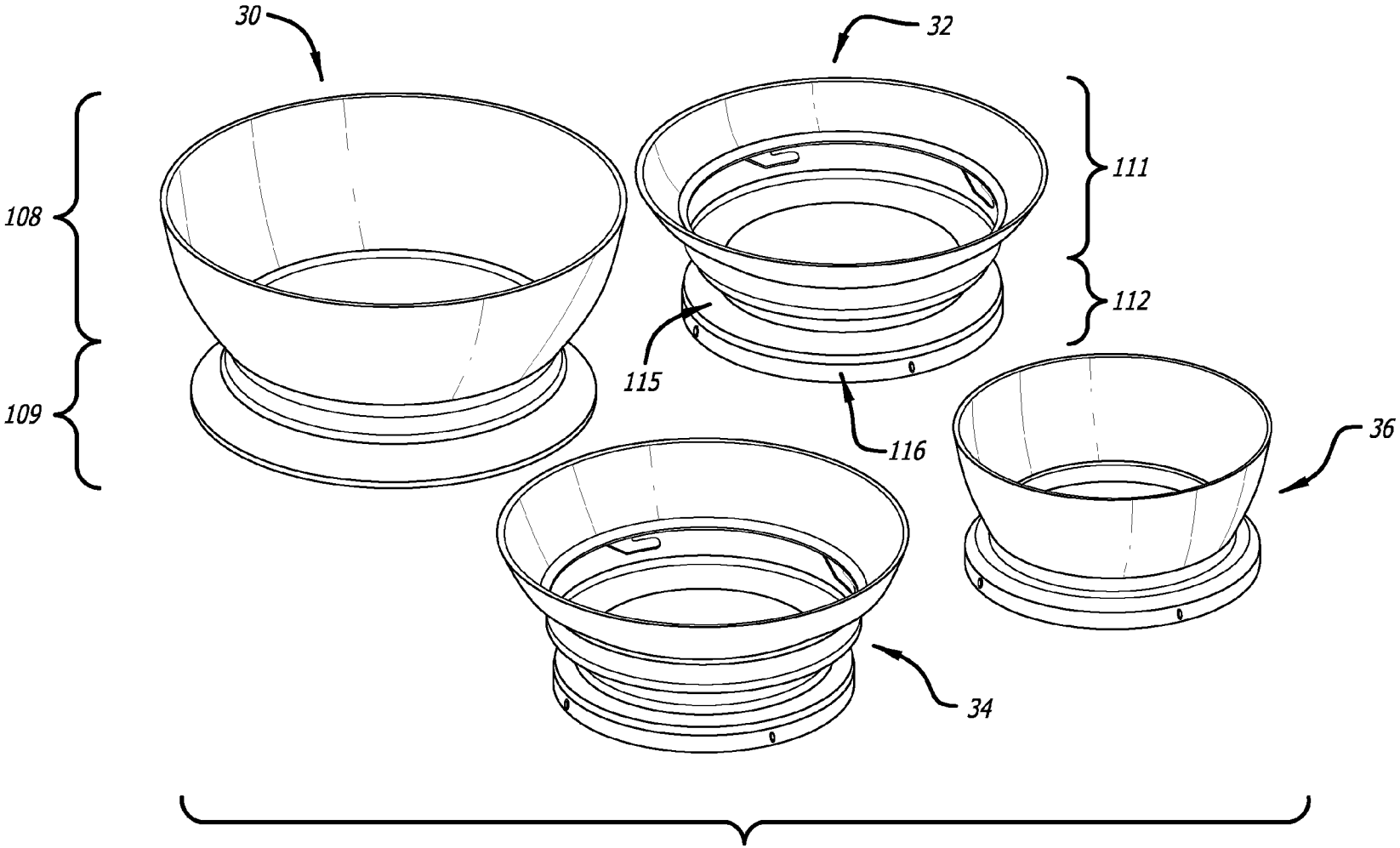
FIG. 10 shows disassembled individual base plates used to form the tower.

After assembling the base plates together, a tower platter which can be used as a seafood (specially a shrimp) plate can be used. The platter has three all around compartments, one for every level for putting crushed ice. Then one can choose to place seafood on top of the ice or submerge the top portion of a shrimp into the ice where they will respectively hang from the edges of the base plates on all three rows. When assembling the base plates, they automatically create small chambers under each base plate where the water from the melted ice can accumulate and the seafood will not appear in the water. The top small size bowel (fourth base plate) is for seafood sauce, where one can submerge the seafood before enjoying it. The other way of using the current invention's tower platter is to turn it upside down where the first bowl which is on the table will be fourth base plate (FIG. 9). At this point the biggest bowl, first base plate, will appear on top. That will become a centerpiece with fruits, vegetables, chips, and other food. The other way of using the base plates, is to take apart the tower and spread the base plates around the table and use them as individual serving bowls for a variety of foods (FIG. 10).

FIG. 1 shows the perspective view of a fully assembled tower (10) with stackable petal plates. This fully assembled tower is made from two or more base plates to form a tower, and petal plates.

Figure 2:
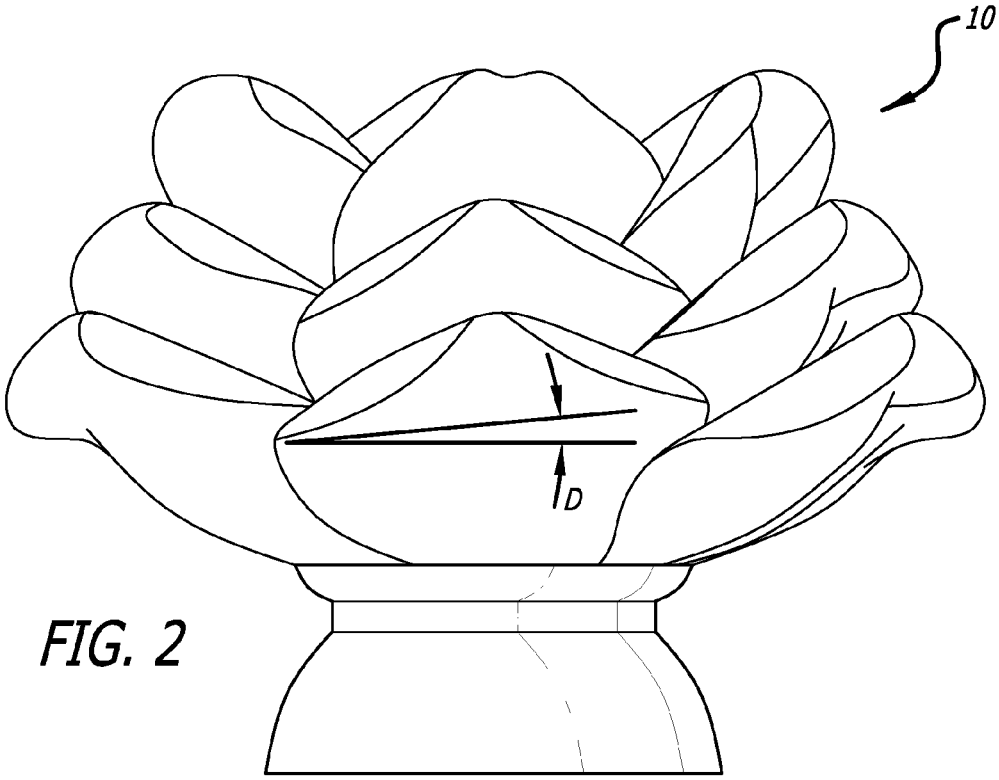
FIG. 2 is a side view of the tower of the depicted in FIG. 1. "D" denotes the tilted angle of the flower petals to allow for stacking multiple petals.

FIG. 2 shows a view of the same fully assembled tower (10). Each petal plate has a tilt, defined by D. the angle is preferably from about 5 to about 15 degrees. The tilted angle allows for placing more petal plates as some portion of the plates can overlap.

FIG. 3 illustrates the assembled tower with base plates and a rose petal plate for each compartment of the stackable petal plates. FIG. 3 shows a partially assembled: tower with base plate 30, base plate 32, base plate 34, base plate-36, big petal plate 38, medium petal plate 40, and small petal plate 42. When placing the petal plate (117) into the compartment of a platter (80, 82, 84), the back surface of the petal plate 202 leans on the border of the base plate 104, and the curvature at the narrowed end of the rose petal 200 is contoured to the external portion of the base plate neck 50, securing better grip and slit tilted position of petal plate shown in FIG. 2 under angle D. In FIG. 3, each subsequent petal has a bigger angle. Petal 42 has a bigger angle than petal 40, and 40 bigger than 38. This frees space for the next petal plate to stack upon the other. Starting from petal plate 38, to small petal plate 42, the angles change A, B, C, to create a look of a blossomed flower as well as to create a space for the hand to pick up a plate without touching the other plates.

It is preferable that petal plates stacked at the bottom compartment be the largest, and then each subsequent compartment above that have smaller petal plates. So petal plate 38 is larger than petal plate 40, and petal plate 40 is larger than petal plate 42.

FIG. 4 illustrates base plates 30, 32, 34, 36 which are detachable attached together Instead of attaching petal plates to the compartments (80, 82, 84), seafood is placed in the all around compartments. The seafood is placed on ice. Each compartment has all around clearance 96 to the chambers 90, 92, 94 which have been created by assembling base plates together. After pouring crushed ice into the compartments, seafood (mussels, clams etc.) is placed in them or submerges into the ice and shrimp can be hung over the protrusions 100, 102, 104 of the base plates. When the ice melts, the water from the melted ice leaks thru the clearance 96 into the chamber, and eliminates the possibility of the seafood appearing in the water. As can be noted, the water level will rise in chamber 90 when the ice is melted. As soon as the water touches the bottom edge 106 of the base plate, it creates an air trap which does not allow the water to rise, and it will build up in the compartment, resulting in the seafood becoming submerged in water. To solve this problem, a small opening or hole 98 (FIG. 7) is created to allow air to leave so liquid can enter. The top plate, base plate-4 36 can be used for seafood sauce.

FIG. 5 shows one of the petal plates which is designed with a unique configuration that will be able to be assembled on the base plates with consideration of the diametrical sizes, the depth and the angles A, B, C as shown in FIG. 3 of the compartment of base plates. Here, the multiple petal plates can be assembled equally spaced and overlapping one another other, but at the same time not interfering with the balance and distribution of the petals. In FIG. 5 the bottom edge of the petal plate 200, has a round cut, which matches with base plate neck diameter 50, and slightly tilted under angle E. Theoretically, angle E and D are the same, but in actual practice, may slightly differ. FIG. 5 shows a rose petal plate with spherical shape (206) with two flaps (204, 208), and a narrowing (118) to obtain a curvature (200) at the end to match that of the tower, particularly the neck of the base plates. A rubber or a non-slippery material (212) can be used to increase the friction. Three points of the plate can be touching a table: the back middle surface 206 of the petal plate and two far edges 204, 208.

Figure 6A:
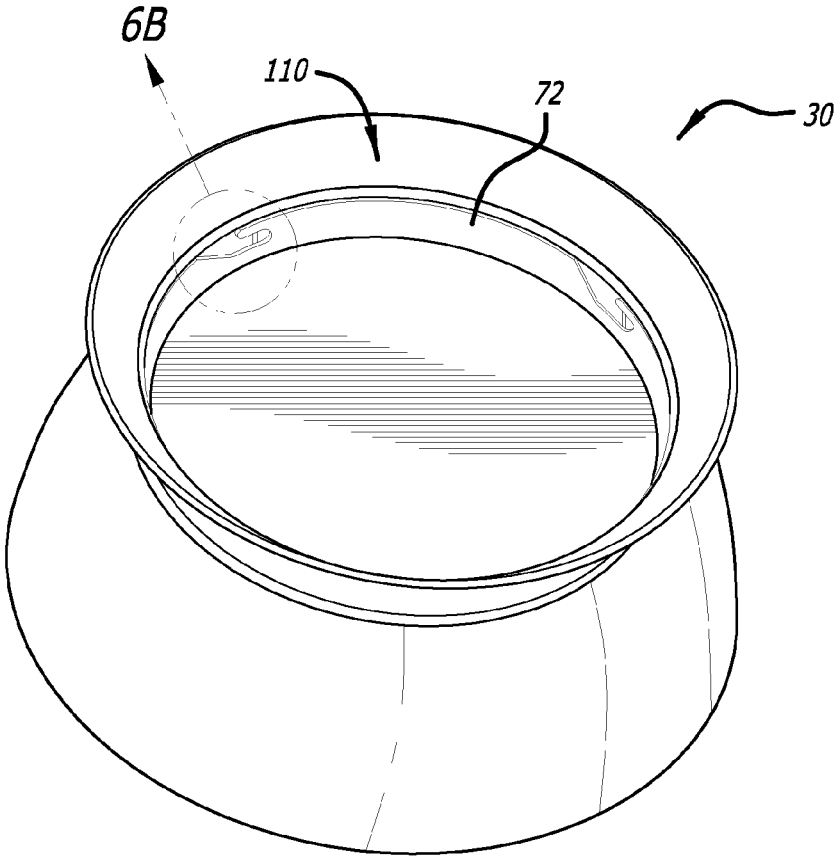
FIGS. 6*a* and *b*, depicts the bottom of a first, inverted individual serving plate, that can serve as the lowest bowl of the tower resembling a flower (6*a*), illustrating notches that can be used to detachably attaching the lower portion of a second plate to the base of the first plate, and to connect successive plates to one another. The notches may include a slight raised portion (6*b*).
Figure 6B:
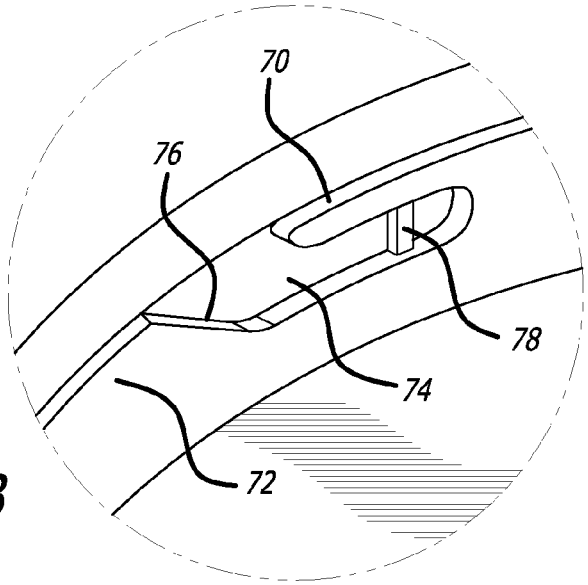

FIG. 6 is an illustration of the bottom portion of the first base plate (30). The bottom portion has multiple lock notches 50, where the second base plate 32 can be set and locked with the locks 60 on the bottom side of the base plate 32. On the base plate, the reduced diameter can create two new surfaces 74 and 72. To assemble base plate 32 over base plate 30 simply insert the lower edge 62 of base plate 32, into the chamber of base plate 30. The edge 62 of the second base plate is slightly smaller then the chamber surface 72 of base plate 30. At that point the lock 60, from the base plate 32, sits on the surface 70 of base plate 30. While the lock 60 touches the surface 70, rotating base plate 32 around the axis, and as soon as the locks 60 reach the opening of the notches 74 they slide in because of the 30 degree slider 76, and stop at the bump 78. After adding a rotational force the locks 60 on base plate 32 jumped the bump 78 and secure their position. To unlock and remove the base plate 30, a rotational force counterclockwise is given and it will jump the bumper 78 and disassemble by sliding up over the surface 76 under a 30 degree angle.

FIG. 6 also shows the protrusion of the first base plate (110) at the bottom portion. This protrusion forms the compartment when adding a second base plate.

FIG. 7 shows a second base plate. The second base plate (32) has a top portion (111) and a bottom portion (112). The top portion has two segments. The first segment (114) is contoured to receive yet another base plate. The second segment (113) protrudes out, and forms a compartment when another base plate is added. The other base plate added preferably has a hollow bottom. The hollow bottom allows for making the space of 114 into an air chamber after addition of another base plate. The air chamber allows for liquid to drain from the compartment. Opening (98) helps in removing air as liquid enters the chamber.

FIG. 8 illustrates the outside of each base plate on the left and inside on the right (one quarter section of each). To prevent the petal plates from sliding and falling down, the surface area all around the neck 50 of the base plates can be non-slippery 52 to improve the grip of the petal plates. To address the same issue, a rough surface on the edge 200 of the petal plates can be made, or non slippery material can be applied 212 on the slippery areas, or rubber can be molded with the plastic at the end of the petal plate, or around the neck of the base plates. Petal plates can have deferent shapes and designs. Considering the importance of the look and the function to pick up the plates easily mentioned above, the borders H1, H2, H3 of the base plates are designed with different heights. The same effect can be made by keeping the heights of the base plates' borders the same, and having the petal plates' curvature 210 be different depending on the level of the compartment.

The assembly of the base plates is sequential according to the diameter of the chambers D1, D2, D3 as well as the corresponding base plates.

FIG. 9 illustrates the use of the stacked tower as a fruit platter. The tower is used with the first base plate, which is the largest and lacks a compartment next to it, on top. The height can be adjusted by removing one or more of the base plates.

FIG. 10 illustrates each individual base plates separately (30, 32, 34, 36). These plates can also independently be used.

The multiuse tower platter can be disposable or reusable. They can be made with stackable party plates out of foam, ceramic, metal, glass, plastic. or other acceptable material. Injection molding or vacuum forming can be used depending on the material.

What is claimed is:

1. A stackable tower for serving food comprising:

a) a first base plate having a bottom and a top portion, with the top portion for placing food, with the bottom portion for supporting the top portion, said bottom portion having a first and a second segment, with the first segment shaped to receive and detachably attach to another base plate, and a second segment below the first segment that protrudes out wherein the first base plate can be used independently to serve food, b) a second base plate having a bottom and a top portion, with the top portion for placing food, with the bottom portion having a size and shape necessary to be detachably attached to the first segment of the first base plate, wherein the second base plate can be used independently to serve food, wherein said first base plate has one or more lock notches;

wherein said second base plate has one or more locks on the bottom side of the second base plate;

wherein the one or more locks of the second base plate detachably attach with the one or more lock notches of the first base plate; and wherein after attaching the first and second base plates, a compartment (80) is formed on an exterior portion of the second base plate and the second segment of the first base plate, wherein food can be placed in the top portion of the first base plate with the second base plate supporting the tower, or food can be placed in the second base plate top portion and the compartment, with the first base plate supporting the tower;

wherein after attaching the first and second base plates, a chamber (90) holding air, water or ice, forms in between the bottom of the first and the bottom of the second plates; and wherein the second base plate includes an opening, the opening is located between the first and second base plates after attaching them to allow for a liquid from the compartment (80) to drain into the chamber.

2. The stackable tower of claim 1, wherein an all-around clearance (96) exists in between the first and second base plates after attaching them to allow for a liquid from compartment (80) clearance to freely drain into the chamber.

3. The stackable tower of claim 1, wherein an additional opening in the second base plate for air to escape as liquid enters the chamber.

4. The stackable tower of claim 1, further comprising detachably attaching one or more additional base plates to the second base plate or each successive plate, wherein each additional plate has a bottom and top portion, with the top portion for placing food, and the bottom portion detachably attaching to the top portion of the second plate or each successive plate in such manner to cut the top portion into a lower and an upper part, the first lower part forming a chamber, and the upper part forming an additional compartment along the exterior of the additional plate.

5. The stackable tower of claim 4, wherein each additional plate creates a compartment that is steeper that the previous compartment, allowing for placing a plate or ornamental object in the compartment at increasing angles.

6. The stackable tower of claim 4, wherein a total of three plates are stacked on the first base plate.

7. The stackable tower of claim 1, wherein plates or ornamental objects are displayed by using the compartment as a support.

8. The stackable tower of claim 7, wherein plates in shape of a flower petal are used.

9. The stackable tower of claim 8, wherein a plate in shape of a rose petal is used, said plate having a spherical shape with one or more flaps, and a narrowing from the flaps to form an edge that is contoured to allow for stacking of the plates.

10. The stackable tower of claim 4, wherein the plates or the ornamental objects have an edge contoured for the tower, wherein the edge is tilted to allow for stacking of multiple plates or ornamental objects.

11. The stackable tower of claim 10, wherein the angle of tilting is about 5 degrees to about 15 degrees from a horizontal plane.

12. The stackable tower of claim 1, wherein all the base plates are circular in shape.

13. The stackable tower of claim 12, wherein an opening forms as a result of diametrical difference between the first and second base plate to allow liquids to drain.

14. The stackable tower of claim 1, wherein the second base plate comprises a top portion and a bottom portion, the top portion having a chamber area for receiving an additional plate and a section protruding outwards from the chamber area, and the bottom portion having a first portion protruding out followed by a section with a compatible shape and size to detachably attach to the first base plate.

15. The stackable tower of claim 1, wherein sauce is put in the second base plate or a subsequently attached plate, and seafood in the compartment next to the second plate or subsequently attached plate.

16. A stackable tower for serving food comprising:

a) a first base plate having a bottom and a top portion, with the top portion for placing food, with the bottom portion supporting the top portion, said top portion having a first and a second segment, with the first segment shaped to receive and detachably attaching to another base plate, and a second segment above the first segment that protrudes out, wherein the first base plate can be used independently to serve food, b) a second base plate having a bottom and a top portion, with the top portion for placing food, with the bottom portion having a size and shape necessary to be detachably attached to the first segment of the first base plate, wherein the second base plate can be used independently to serve food, wherein after attaching the first and second base plates, a compartment is formed on an exterior portion of the second base plate and the second segment of the first base plate, and food can be placed in the second base plate and the compartment, with the first base plate supporting the tower;

wherein the first base plate is larger than the second base plate; and wherein after attaching the first and second base plates, a chamber holding air, water or ice, forms in between the bottom of the first and the bottom of the second plates; and wherein the second base plate includes an opening, the opening is located between the first and second base plates after attaching them to allow for a liquid from the compartment (80) to drain into the chamber.

17. The stackable tower of claim 16, further comprising an additional base plate.

18. The stackable tower of claim 16, further comprising additional plates or ornamental objects that are displayed by using the compartment as a support.

19. The stackable tower of claim 16, wherein food can be served on the bottom of the first base plate.

* * * * *